US005121620A

United States Patent [19]

Haulsee

[11] Patent Number: 5,121,620

[45] Date of Patent: Jun. 16, 1992

[54] RETRACTABLE CUPFEED FOR CAN BODYMAKER

[75] Inventor: Donald R. Haulsee, Richmond, Va.

[73] Assignee: Reynolds Metals Company, Richmond, Va.

[21] Appl. No.: 732,900

[22] Filed: Jul. 19, 1991

[51] Int. Cl.[5] ..... B21D 22/30

[52] U.S. Cl. ..... 72/4; 72/361

[58] Field of Search ..... 72/3, 4, 347, 349, 361

[56] References Cited

U.S. PATENT DOCUMENTS

| | | | |
|---|---|---|---|
| 3,379,153 | 4/1968 | Smith et al. | 72/361 |
| 3,448,604 | 6/1969 | Finsterwalder | 72/346 |
| 3,628,368 | 12/1971 | Cvacho | 72/361 |
| 4,061,012 | 12/1977 | Wessman | 72/347 |
| 4,534,202 | 8/1985 | Snyder | 72/349 |
| 4,928,511 | 5/1990 | Sirvet | 72/361 |

*Primary Examiner*—Lowell A. Larson
*Attorney, Agent, or Firm*—Alan T. McDonald

[57] ABSTRACT

A cupfeeder for feeding cups from a supply chute to a feed location in operative alignment with a drawing and ironing machine is disclosed. The cupfeeding mechanism comprises a push rod mechanism mechanically driven in reciprocating strokes to advance a cup which has dropped from the lower end of the chute to the feed location along a transfer path defined by a positioning member. The push rod mechanism includes an inner push rod extending telescopically from an outer push rod driven by the reciprocating drive. The inner push rod is maintained by pressurized fluid in a fixed axial location, relative to the outer push rod, to project forwardly therefrom to a maximum extent to engage the cups in the cupfeeding process. In response to jamming of a cup within the drawing and ironing station, pressurized fluid is re-routed within the outer push rod to retract the inner push rod and prevent further transfer of cups along the transfer path. The cupfeeder also includes a cylinder actuated stop adapted to enter the transfer path in response to said jamming. A further stop arrangement may be provided within the chute to prevent a next in-line cup from dropping through the chute into the transfer path.

18 Claims, 3 Drawing Sheets

RETRACTABLE CUPFEED FOR CAN BODYMAKER

TECHNICAL FIELD

The present invention relates generally to drawing and ironing presses for manufacturing containers from cylindrical metal cups and, more particularly, to a cupfeeding mechanism for sequentially transferring cups from a continuous supply into operative alignment with a punch of the drawing and ironing press. More specifically, the invention relates to a cupfeeding mechanism which is responsive to a jammed condition within the D&I press to prevent feeding of further cups into the press.

BACKGROUND ART

Two-piece metal containers (e.g., beverage cans made of steel or aluminum) generally comprise an integral body wall and a container side wall having an end attached to the side wall to form the finished container. In forming such containers, a circular blank of metal stock is first deformed into a shallow cup. These cups are placed within a vertical chute (with their open ends facing sideways) and sequentially gravity fed through the chute bottom onto a positioning device where they are contacted by a horizontally extending reciprocating piston for transfer to a location in alignment with the punch.

The drawing and ironing press generally comprises a tool pack having an opening in alignment with a plurality of axially spaced forming rings therewithin. The punch is located on the front end of the reciprocating ram and cooperates with the rings to deform the cup into a container having the bottom wall of a particular configuration and a generally cylindrical side wall. The punch is typically driven with a crank and in the forward stroke the punch engages the inside surface of the cup bottom wall (positioned by the cupfeeder into alignment with the tool pack opening) with the side wall extending along the punch sides. Continued movement of the punch in its forward forming stroke causes the cup side wall to be stretched by the rings. The process is completed when the working end of the punch and cup exit the tool pack where the cup is removed by known means. The punch then withdraws through the tool pack and rearwardly of the alignment opening to enable the next in-line cup to be transferred to the opening via the piston and cylinder arrangement.

A known sensor is positioned outside the tool pack to determine whether a formed can has exited the tool pack with the punch. The absence of the can on the punch indicates that a tear-off or jam has occurred within the tool pack. The sensor triggers shutdown of the press and punch as well as disruption of the piston and cylinder assembly in its cupfeeding operation. However, the press punch and the cupfeed piston will typically require from one to three strokes to come to a complete halt and, on each of these strokes, an additional cup is fed into the tooling which creates a larger jam that may damage the tooling. Such tooling damage occurs when more than one thickness of metal is formed by the dies. Also, multiple cup jams will typically require the machine operator to place his hands in the tooling to remove the broken metal pieces, increasing the likelihood of operator injury.

It is accordingly one object of the present invention to provide a drawing and ironing press or machine with a positive cupfeeder mechanism which is capable of high speed and reliable operation with rapid shutdown in the event of jamming.

Another object of the invention is to provide a cupfeeder mechanism having a cup engaging push rod which is capable of retracting at any point in its reciprocating stroke in response to sensing of a jam within the drawing and ironing machine.

Still another object of the invention is to provide a retractable cupfeeder that also prevents further cups in the cup chute from dropping to a supply location in the transfer path to further minimize the likelihood of additional cups entering the tooling.

Yet another object is to provide yet further means entering the transfer path to prevent a cup in the supply location at the time the jam occurs from inadvertently or positively moving to the feed location (opening) in alignment with the tool pack.

Still another object is to provide a retractable cupfeeder having preselected low mass components so that the inertia of the retracting push rod components is small and its strength and rigidity high so as to enable instantaneous (e.g., 30 milliseconds at 500 cans per minute) retraction to occur during high speed normal running operation.

SUMMARY OF THE INVENTION

Apparatus for positioning a workpiece into a drawing and ironing station of an associated machine, in accordance with the present invention, comprises a positioning member having a guide surface which includes a feed location in alignment with the drawing and ironing station and a chute supplying at least one workpiece to a predetermined supply location of the positioning member which is spaced from the feed location. A push rod arrangement, movable in reciprocating strokes, has a forward end directing the workpiece along the guide surface from the supply location to the feed location in the forward stroke. The forward end of the push rod arrangement may be quickly retracted during the forward stroke to avoid contacting a workpiece in the supply location in the event of a jammed condition within the drawing and ironing station.

The push rod arrangement comprises an outer push rod connected to a crank for reciprocating movement thereby and an inner push rod telescopically mounted in the outer push rod for corresponding reciprocating movement. The inner push rod extends forwardly from the outer push rod to define the forward end of the push rod arrangement. First stop means is provided between the inner and outer push rods for defining the forward extent of the inner push rod and second stop means defines a retracted position of the inner push rod within the outer push rod.

During normal running operation, the inner push rod is maintained in an axially fixed forward position, relative to the outer push rod, by means of a pressurized fluid acting on the inner push rod through the outer push rod. In response to sensing of the jammed condition of a workpiece within the drawing and ironing station, the pressurized fluid is re-routed to retract the inner push rod towards the second stop means. Although the outer push rod may continue to reciprocate by the crank action, the inner push rod is effectively displaced from contacting the workpieces in the transfer path to prevent further feeding of workpieces to the drawing and ironing station.

The reciprocating push rod arrangement preferably comprises the outer push rod horizontally reciprocating within an outer bearing housing having bearings at opposite ends thereof. A first interior cylindrical region of the housing defines a first annular cavity between the housing and outer push rod. A second interior cylindrical region within the outer push rod defines a second annular cavity between the outer push rod and the inner push rod. The rear end of the second interior cylindrical region is defined by a step portion of smaller diameter than the second region and through which the inner push rod extends rearwardly to terminate in a piston head. An annular passageway is defined between the inner push rod and the step portion forwardly of the piston head. The piston head is in sealing sliding contact with a third interior region of the outer push rod located rearwardly of the step portion. The step portion functions as a first stop defining the maximum forward extent and normal position of the inner push rod during normal operation of the D&I station. During such operation, the inner push rod is maintained in its maximum forward position against the first stop by the action of pressurized fluid entering the third region of the outer push rod through a rear opening thereof.

Upon sensing a jammed condition within the D&I station, pressurized fluid is admitted through a fitting in the outer bearing housing and directed through the first and second annular cavities and annular passageway to contact the opposite or front side of the piston and thereby retract the inner push rod into the outer push rod.

In accordance with another feature of the invention, a cup stop cylinder is positioned so that a piston rod thereof may project into the transfer path in response to detection of jamming to prevent a cup from moving from the supply to the feed location. The piston rod may be extended by means of the pressurized fluid entering the cylinder.

A like piston and cylinder arrangement may also be mounted to the chute to prevent gravity feed of a next in-line workpiece from the chute into the supply location beneath the lower end. This second piston and cylinder arrangement may also be actuated by the pressurized fluid.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
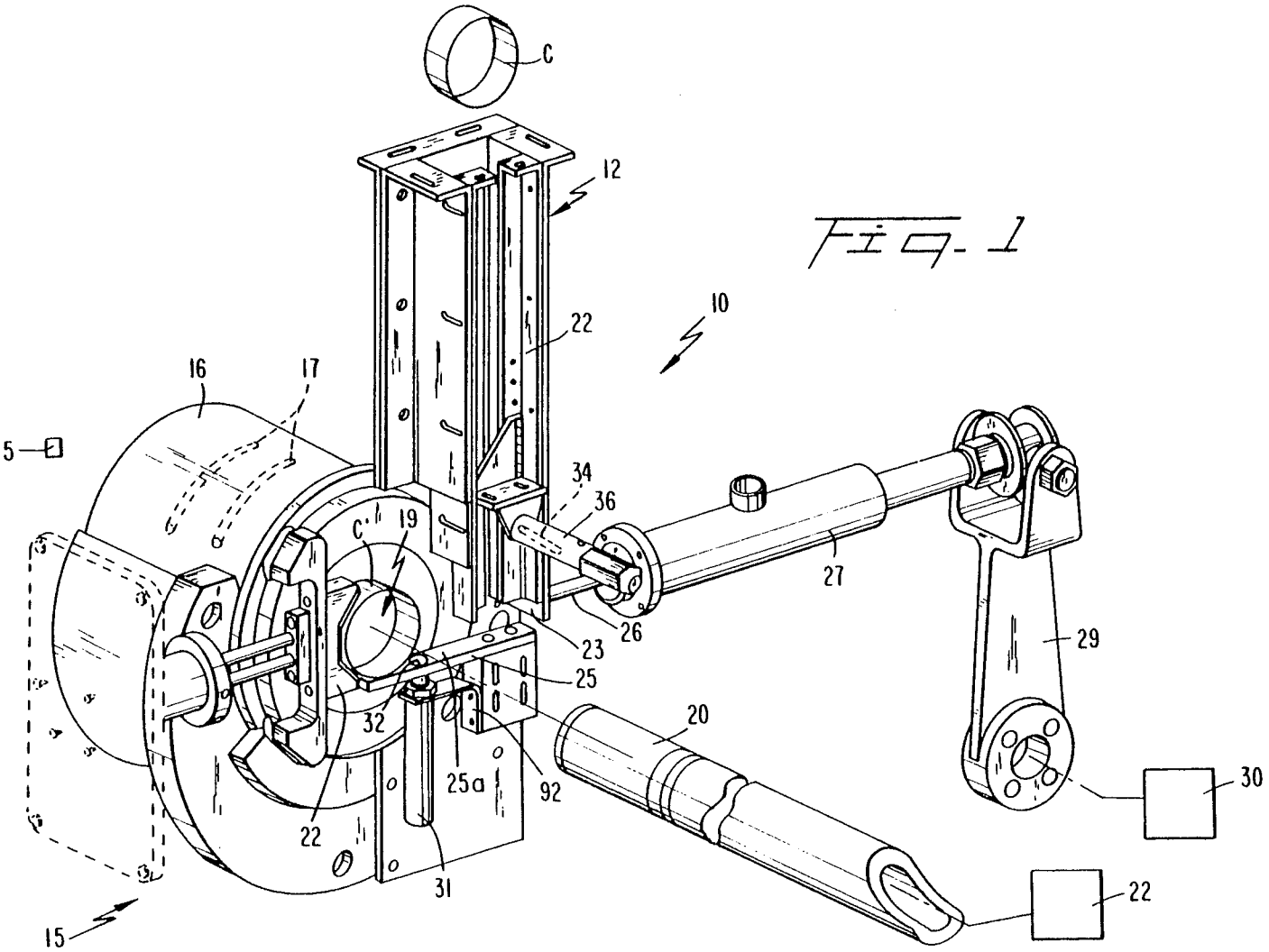
FIG. 1 is a perspective view of a retractable cupfeeder in accordance with the present invention.

FIG. 1 is an illustration of a retractable cupfeeder 10 of the present invention adapted to sequentially feed cups C from a chute 12 into a drawing and ironing (D&I) press generally indicated with reference numeral 15. More specifically, the drawing and ironing press 15 includes a tool pack 16 having plural axially spaced ironing rings 17 defining an opening 19 aligned with a punch 20. The punch 20 is driven in reciprocating strokes via a crank mechanism 22. The leading end of the punch 20 engages a cup C, which has been placed by cupfeeder 10 against stops 22 into accurate alignment with opening 19.

In the forming stroke of punch 20, the cup C is drawn through the tool pack 16 in a high speed operation that thins and elongates the cup to form a single piece can body or container having a bottom wall and an integral side wall of substantially circular cylindrical configuration. An annular outer portion of the side wall may be sequentially trimmed and necked in or flanged to receive an end closure defining a completed container. Since the remaining details of the drawing and ironing machine or subsequent processes do not form part of the present invention, no detailed description thereof is necessary.

During normal running operation, the cups C are fed into the D&I press 15 on a continuous basis. However, when a tear off or other jam occurs within the tool pack 16, the press is shut down, halting cupfeed as the press stops. The punch ram will typically require from one to three strokes to come to a complete halt and, on each of these strokes, an additional cup is fed into the tooling. This creates a larger jam and frequently damages the tooling. In accordance with the present invention, cupfeeder 10 prevents cups from entering the tool pack by providing a unique retractable push rod mechanism to disrupt further feeding of cups into opening 19 aligned with the ram or punch 20.

Guide chute means 12 includes a supply chute 22 extending vertically adjacent alignment opening 19 and has a lower end 23 located adjacent but axially offset from the opening 19. The cups C are sequentially gravity fed through lower end 23 so that the bottommost cup rests (supply location) on a horizontal positioning bar 25 with the cylindrical side wall of the cup, as viewed in FIGS. 1 and 4, elevationally coextensive with a reciprocating push rod mechanism 26 extending from a piston and cylinder assembly 27 of the cupfeeder 10. In its forward or feed stroke (FIG. 3), the push rod 26 moves the cup C along the upwardly directed horizontal surface 25*a* of bar 25 so that the cup side wall engages stops 22 to be accurately positioned (feed location) thereby coaxially adjacent the alignment opening 19.

As the push rod 26 retracts in its return stroke, the next in-line bottommost cup drops through chute lower end 23 onto positioning bar 25 for feeding into opening 19 by push rod 26 in the manner described above. The push rod 26 and piston of the cylinder assembly 27, as a unit, are reciprocated by a mechanical pivot arm 29 connected to a commercially available and therefore conventional indexing box schematically depicted at 30.

As the punch 20 exits from the tool pack 16 at the forward end of its forming stroke, a conventional sensor S is mounted in a known manner to determine whether the formed can has been pushed through the tool pack 16. The absence of a can on the punch end 20 indicates that the cup has been torn from the punch and is jammed within the tool pack 16. When such a machine jam occurs, a solenoid valve (not shown) is actuated by the sensor S resulting in the following:

1. In the preferred embodiment, pressurized fluid is supplied to the piston and cylinder assembly 27 to retract (FIG. 4 only) the forward end of the push rod mechanism 26 into the cylinder in the unique manner described below. Thus, even if the pivot arm 29 continues to reciprocate the piston and cylinder assembly before cycling to a complete halt, any bottommost cup which has dropped through chute lower end 23 onto positioning bar 25 will advantageously not be propelled by the push rod mechanism into alignment with the punch 20 at opening 19. This can best be seen in FIG. 4 wherein the push rod mechanism is advanced by the crank into its forwardmost feed position (compare with the retracted position of FIG. 3). However, in response to a jam as detected by sensor S, the forward end of the push rod mechanism has retracted (compare with its normally extended feed position depicted in FIG. 3) to disrupt feeding.

2. Pressurized fluid is supplied to a cylinder 31 having a cup stop piston 32 adapted to extend upwardly into the feed path defined by guide surface 25*a* between the lower end 23 of supply chute 22 and the cupfeed location in alignment with opening 19. The piston 32 prevents the bottommost cup C from being fed via push rod mechanism 26 to the cupfeed position or otherwise prevents the bottommost cup from rolling along surface 25 to the feed location; and 3. A second piston 34 is extended from a cylinder 36 mounted to supply chute 22 to enter the supply chute and prevent the next in-line cup from dropping onto the positioning bar 25 into alignment with the cupfeed push rod mechanism 26.

Figure 2:
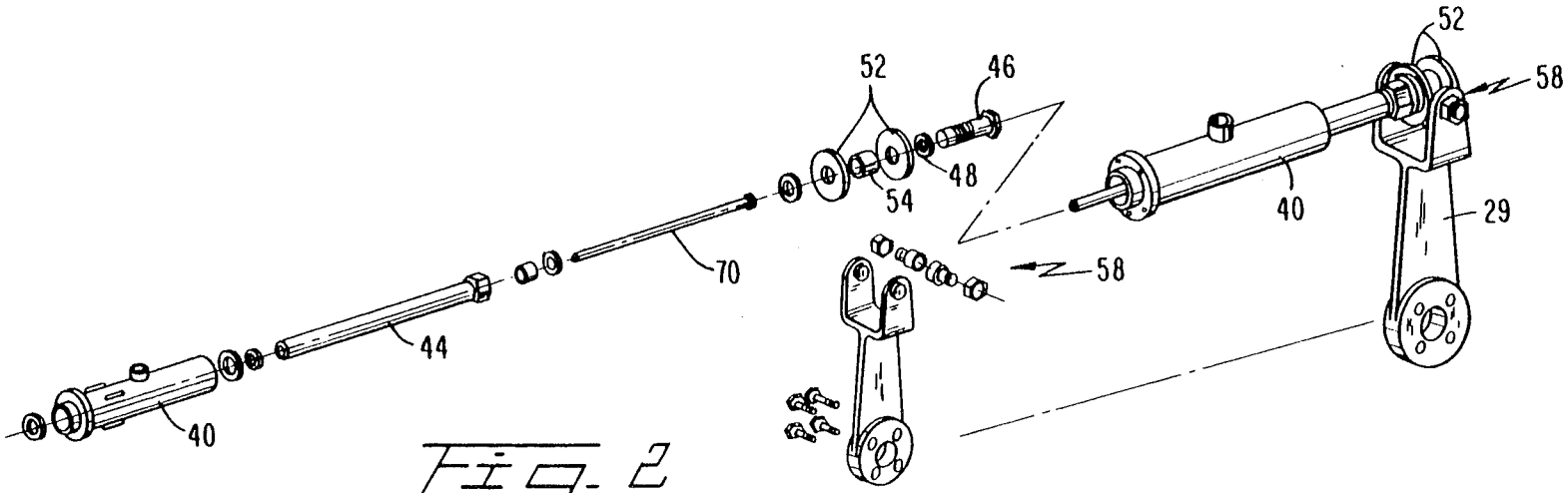
FIG. 2 is an exploded perspective view of the cupfeeder of FIG. 1.
Figure 3:
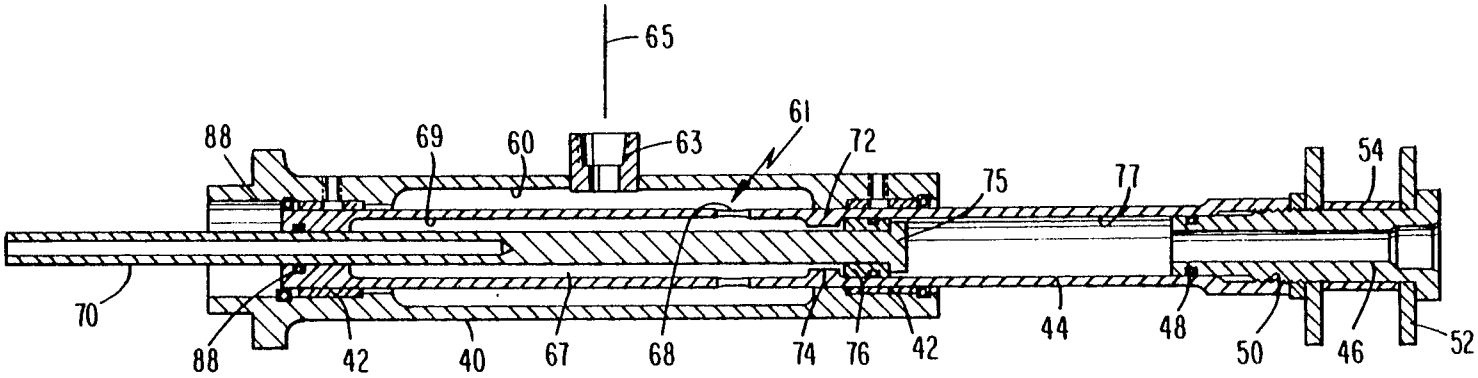
FIG. 3 is a cross-sectional view of the cupfeeder.
Figure 4:
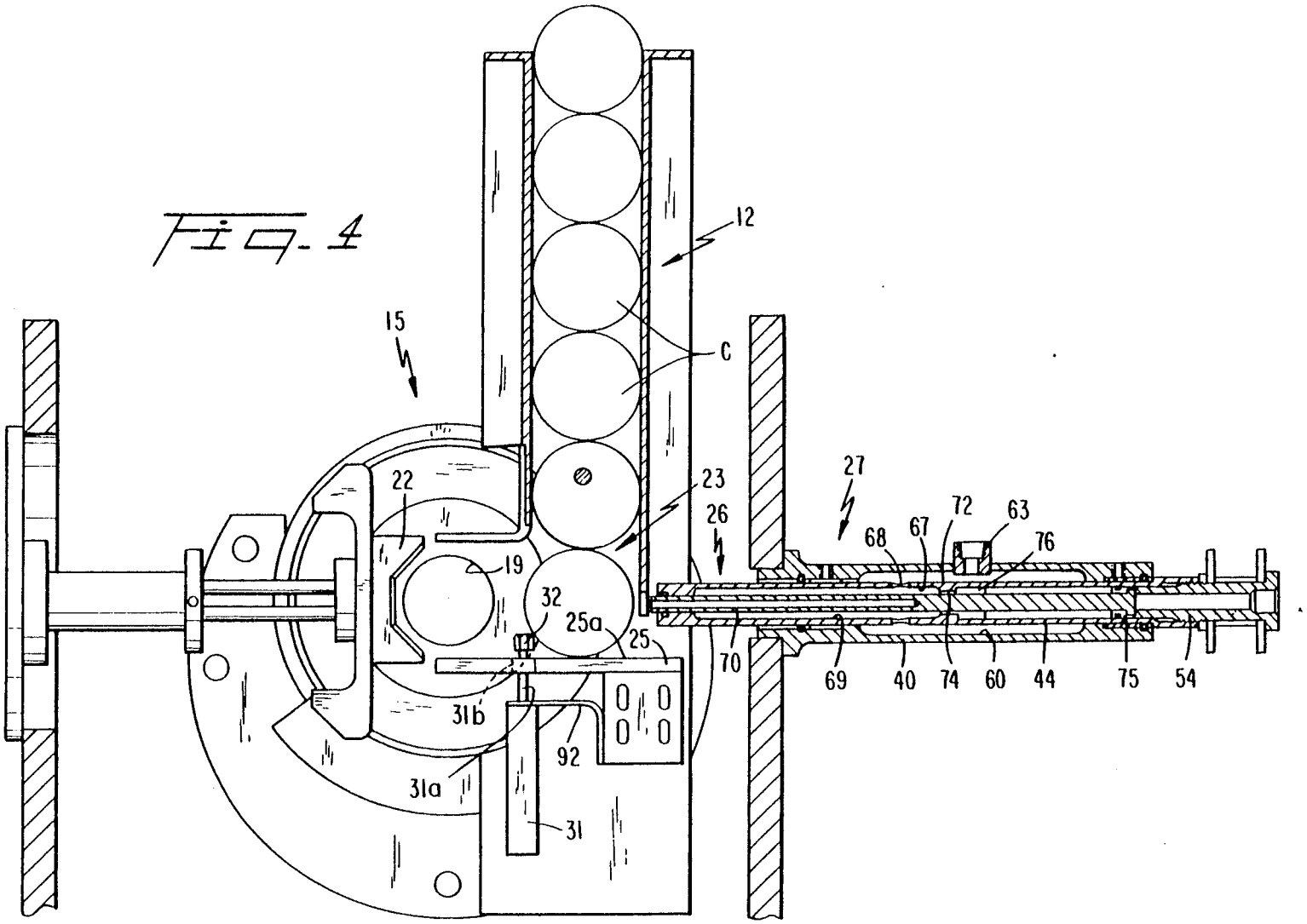
FIG. 4 is a side elevational view depicting the inner push rod in its retracted mode in response to jamming of a cup within a drawing and ironing station.

The cupfeeder assembly 10, with reference now to FIGS. 2 and 3, comprises an outer bearing housing 40 stationarily secured to a machine frame (not shown) of the D&I press 15 and which contains bearings 42 (e.g., grease lubricated bronze bearings) at opposite ends thereof receiving a cylindrical hollow outer push rod 44 reciprocating within the bearing housing.

A push rod stop 46 having an O-ring seal 48 is threaded within an enlarged internally threaded rear end bore 50 formed in the outer push rod 44 extending rearwardly from the outer bearing housing. A pair of parallel cam follower plates 52 are mounted to the end of the push rod stop 46 and are retained in parallel spaced relationship with a spacer 54. A rod positioning spacer 56 between the innermost cam follower plate 52 and rear end bore 50 of the outer push rod 44 cooperates with the first spacer 54 to function as length adjustment spacers to control the stroke length of push rod mechanism 26. A clevis and pin arrangement 58 at the upper end of the pivot arm 29 connects the push rod mechanism 26 to the indexing mechanism 30 to provide mechanical reciprocating movement in the cupfeeding process.

A central interior cylindrical portion 60 of the outer bearing housing 40 is of larger diameter than the end portions carrying the bearing members to define an annular cavity 61 extending about the outer push rod 44. A tapped fitting 63 in the side wall of the outer bearing housing 40 is connected to a compressed air line (schematically depicted as 65) to provide compressed air (i.e., pressurized fluid) into the annular cavity 61 when a machine jam occurs in the manner described below. This compressed air in turn enters an annular cavity 67, through an opening 68 formed in the outer push rod, defined between an interior hollow cylindrical region 69 in the forward portion of the outer push rod 44 and an inner push rod 70 extending therethrough. Rearwardly adjacent the interior cylindrical region 69 of the outer push rod 44 is a stepped portion 72 of smaller diameter than the enlarged cylindrical region 69 and greater diameter than the outer diameter of the inner push rod 70 to define an annular passageway 74 therewith. A spacer 76 is positioned against the rear annular stop shoulder of the step 72 to define a forwardmost position of the inner push rod 70 by engagement of an enlarged rear cylindrical end 75 of the inner push rod with the rear end of the spacer. End 75 defines a piston in sealing sliding relationship with a rearwardly located hollow interior region 77 of the outer push rod 44 extending between the push rod stop 54 and step 72.

In normal running operation, compressed air is fed through the hollow push rod stop 54 into the rear interior region 77 (FIG. 3). This compressed air advances piston 75 against spacer 76 to project the forward end of the inner push rod 70 from the forward end of the outer push rod 44 (and outer bearing housing 40) and thereby maintain the forward end of the inner push rod at a fixed constant distance relative to the outer push rod via engagement of the piston 75 with the spacer 76 and step under the action of compressed air.

In normal running operation, as mentioned above, the outer push rod 44 is reciprocated by the pivot arm 29 to mechanically drive the inner push rod 70 in reciprocating strokes while the inner push rod remains in an axially fixed position relative to the outer push rod due to the aforesaid action of compressed air. In this manner, it is the forward end of the inner push rod 70 that actually contacts the side wall of the cup to advance the same into the alignment opening 19.

When a machine jam occurs, a solenoid valve vents the air in the outer push rod rear chamber 77 and air is then supplied to the other (front) side of the piston 75 through the tapped fitting 63, annular cavity 60, opening 68, annular cavity 69 and annular passageway 74. In this manner, the inner push rod 70 retracts into the outer push rod 44 (by the action of piston 75 sliding rearwardly through chamber 77 towards rear stop 54) to retract the forward end of the inner push rod in the manner depicted in FIG. 4. Simultaneously, compressed air is supplied to the double acting air cylinder 30 in the bottom of the positioning bar 25 and to the double acting air cylinder 36 within the cup chute 22. The bottom air cylinder 31, as mentioned above, thereby places stop 32 in front of the bottommost cup (FIG. 4) beneath lower end 23 while the double acting cylinder 36 positions stop 34 between the bottommost cup and the next in-line cup still within the chute.

At high speed operation, the available time between detecting a machine jam condition and stopping the cupfeed is very short, i.e., approximately 30 milliseconds at a feed rate of 500 cans per minute. To stop cupfeed under these conditions, the inertia of the moving inner push rod 70 must be very small and its strength of rigidity high. Thus, in accordance with the invention, the push rod is preferably manufactured of a low mass material capable of satisfying these requirements. A preferred material is titanium since it has been found that steel (i.e., heavier mass) would require greater air pressure to retract within the given time constraints and therefore could only work at lower manufacturing speeds for reduced output. The outer push rod 44, however, may be manufactured of steel which is cheaper than titanium to thereby lower the manufacturing costs of the cupfeeder.

O-ring seals 88 are provided between the outer bearing housing 40 and outer push rod 44 and the inner push rod 70 and the outer push rod to prevent undesirable air leakage. Furthermore, the axial extent of the annular cavity 61 between the outer bearing housing 40 and outer push rod 44 is greater than the stroke length of the cupfeeder to ensure that the radial opening 68 in the outer push rod between the annular cavities 61,67 is available to quickly admit pressurized air to the opposite side of the piston 75 to obtain a reliable retraction mode of the inner push rod.

The cup stop 32 adapted to project upwardly from surface 25*a* of positioning bar 25 will prevent the bottommost cup C from rolling into the alignment opening 19 of the tool pack 16. The cup stop is a cylindrical projection secured to the upper end of a piston rod 31*a* disposed within the cylinder 31. The cylinder 31 is mounted via a strap 92 to extend vertically below the positioning bar 25. The stop 32 itself is received within a hole 31*b* in the positioning bar 25 and has an outer diameter corresponding to the inner diameter of the hole to present an uninterrupted smooth surface when not in use.

The cup chute stop 34 may be similar construction to the cup stop 32 and therefore comprises a cylinder 36 extending horizontally adjacent the cup chute 22 from its connection to support plates 94 secured to the chute.

While present exemplary embodiments of this invention, and methods of practicing the same, have been illustrated and described, it will be recognized that this invention may be otherwise variously embodied and practiced by those skilled in the art.

I claim:

1. Apparatus for positioning a workpiece into a drawing and ironing station of an associated machine, comprising:

(a) a positioning member having a guide surface which includes a feed location in alignment with the D&I station;

(b) means for supplying at least one workpiece to a predetermined supply location on said positioning member which is spaced from the feed location;

(c) rod means, movable in reciprocating strokes, and having a forward end for directing the workpiece from the predetermined supply location to the feed location in the forward stroke; and (d) means for selectively retracting the forward end of the rod means to prevent contact between the rod means and a workpiece in the supply location in the forward stroke.

2. The apparatus of claim 1, further comprising a crank means for driving the rod means in said reciprocating strokes, said rod means including an outer push rod connected to the crank for reciprocating movement thereby; an inner push rod telescopically mounted in the outer push rod, said inner push rod extending forwardly from the outer push rod to define the forward end of the rod means; first stop means between the inner and outer push rods for defining the retracted position of the inner push rod within the outer push rod.

3. The apparatus of claim 2, further comprising sensing means for sensing jamming of the workpiece within the D&I station; valve means, operable in response to a signal from the sensing means, for directing a pressurized fluid into the outer push rod on one side of the first stop means to move the inner push rod toward the second stop means in the retraction mode.

4. The apparatus of claim 3, further comprising an outer bearing housing having bearings at opposite ends thereof receiving the outer push rod in sealing, sliding relationship, an interior cylindrical region of the outer bearing housing defining a first annular cavity between the housing and the outer push rod, said outer push rod having a second interior cylindrical region defining a second annular cavity between the outer push rod and the inner push rod extending through the second annular cavity, the rear end of the second interior cylindrical region being defined by a step through which the inner push rod extends rearwardly and defines an annular passageway therewith, said step being the first stop means, the inner push rod having an enlarged rear end in sealing sliding contact with an interior region of the outer push rod rearwardly of the first stop, said enlarged rear head defining a piston having one side in communication with the first and second annular cavities through the annular passageway to retract the inner push rod in response to said pressurized fluid being admitted into said passageway through said cavities.

5. The apparatus of claim 4, further comprising fitting means in the outer bearing housing for admitting pressurized fluid into the first annular cavity, inlet port means in the side wall of the outer push rod to provide communication between the first and second annular cavities, said first cavity having an axial extent such that the inlet port means is always in communication with the first cavity during reciprocation of the outer push rod during normal operation.

6. The apparatus of claim 4, wherein the other side of the piston is in communication with a source of pressurized fluid which urges the piston against the first stop means to extend and maintain the inner push rod in its forwardmost position during normal operation.

7. The apparatus of claim 1, further comprising workpiece further stop means movable to project into a workpiece transfer path to prevent movement of the workpiece from the supply location to the feed location.

8. The apparatus of claim 7, wherein said positioning member is a bar secured to the machine frame and having an upwardly directed guide surface with the feed and supply locations defined at opposite ends thereof, said further stop means being a cylinder and piston rod means extending therefrom through an opening in the guide surface to project into the transfer path.

9. The apparatus of claim 8, further comprising sensing means for sensing jamming of the workpiece within the D&I station; valve means, operable in response to a signal from the sensing means for directing pressurized fluid to initiate retraction of the forward end of the rod means and to cause said piston rod means to project into the transfer path.

10. The apparatus of claim 1, wherein said supply means is a chute, and further comprising additional stop means for entering the chute above a bottommost workpiece which has been discharged from the chute onto the positioning member to prevent a next in-line workpiece in the chute from being located on the positioning member.

11. A method for positioning a workpiece at a feed location in operative alignment with a drawing and ironing station of an associated machine, comprising the steps of:

(a) supplying at least one said workpiece to a predetermined supply location which is spaced from the feed location;

(b) moving the workpiece by means of a reciprocating rod from the supply location to the feed location along a transfer path defined therebetween;

the workpiece, with a punch, from (c) directing the workpiece, with a punch, from the feed location into the drawing and ironing station;

(d) sensing whether jamming of a workpiece within the D&I station has occurred; and (e) causing a forward end of the rod to retract, in response to a signal from the sensing means indicating a jammed condition, such retraction occurring independent of operation of a mechanism moving the rod in reciprocating strokes.

12. The method of claim 11, comprising the further step of moving a stop member into the transfer path between the supply and feed locations to prevent further placement of a workpiece in the feed location along the transfer path.

13. The method of claim 12, wherein said workpieces are sequentially supplied to the supply location from a chute, and comprising the further step of placing a further stop means in the chute, in response to a signal from the sensor means indicative of a jammed condition in the D&I station, to prevent a next in-line workpiece in the chute from reaching the supply location.

14. Apparatus for positioning a workpiece into a drawing and ironing station of an associated machine, comprising:

(a) a positioning member having a guide surface which includes a feed location in alignment with the D&I station;

(b) means for supplying at least one workpiece to a predetermined supply location on said positioning member which is spaced from the feed location;

(c) rod means, movable in reciprocating strokes, and having a forward end for directing the workpiece from the predetermined supply location to the feed location in the forward stroke;

(d) workpiece further stop means movable to project into a workpiece transfer path to prevent movement of the workpiece from the supply location to the feed location;

(e) means for selectively retracting the forward end of the rod means to prevent contact between the rod means and a workpiece in the supply location in the forward stroke;

(f) wherein said supply means is a chute, and further comprising additional stop means for entering the chute, said additional stop means preventing a next in-line workpiece in the chute from being located on the positioning member after a bottommost workpiece has been discharged from the chute onto the positioning member.

15. The apparatus of claim 14, further comprising a crank means for driving the rod means in said reciprocating strokes, said rod means including an outer push rod connected to the crank for reciprocating movement thereby; an inner push rod telescopically mounted in the outer push rod for reciprocating movement therewith, said inner push rod extending forwardly from the outer push rod to define the forward end of the rod means; first stop means between the inner and outer push rods for defining the forward extent of the inner push rod; second stop means between the inner and outer push rods for defining a retracted position of the inner push rod within the outer push rod.

16. Apparatus for positioning a workpiece into a drawing and ironing station of an associated machine, comprising:

(a) chute means for containing a supply of said workpieces;

(b) transfer path means extending from a supply location at one end thereof which is positioned beneath the lower end of the chute means to sequentially receive a workpiece to a feed location at the opposite end thereof which is located to position a workpiece in operative alignment with the drawing and ironing station;

(c) means for moving a workpiece from the supply location to the feed location;

(d) stop means for disrupting the flow of a workpiece along the transfer path in response to a predetermined signal by the forceful placement of said stop means in the transfer path between the feed and supply locations; and (e) means for sensing jamming of a workpiece within the D&I station and which provides said predetermined signal to actuate said stop means.

17. The apparatus of claim 16, wherein said moving means is a reciprocating rod having a forward end adapted to displace a workpiece along the transfer path from the supply location to the feed location and further including means for retracting the forward end of the reciprocating rod to prevent such displacement in response to said predetermined signal.

18. The apparatus of claim 17, wherein said forward end of the reciprocating rod is retracted to prevent said displacement with such retraction occurring independent of whether the rod is in its forward or return stroke.

* * * * *